US005261826A

United States Patent [19]

Leeb et al.

[11] Patent Number: 5,261,826

[45] Date of Patent: Nov. 16, 1993

[54] DEVICE FOR CONTACTING SHIELDED CONDUCTORS

[75] Inventors: Karl-Erik Leeb, Djurhamn; Ulf I. Holmberg, Järfälla, both of Sweden

[73] Assignee: Telefonaktiebolaget L M Ericsson, Stockholm, Sweden

[21] Appl. No.: 897,822

[22] Filed: Jun. 12, 1992

[30] Foreign Application Priority Data

Jun. 14, 1991 [SE] Sweden ..... 9101836

[51] Int. Cl.[5] ..... H01R 9/09

[52] U.S. Cl. ..... 439/67; 333/246

[58] Field of Search ..... 439/67, 77, 493, 495; 333/33, 246, 238, 260

[56] References Cited

U.S. PATENT DOCUMENTS

| | | | |
|---|---|---|---|
| 3,356,983 | 12/1967 | Johnson, Jr. | 439/67 |
| 4,116,516 | 9/1978 | Griffin | 439/67 |
| 4,150,420 | 4/1979 | Berg | 361/401 |
| 4,458,967 | 7/1984 | King et al. . | |
| 4,639,053 | 1/1987 | Reichardt et al. . | |
| 4,747,785 | 5/1988 | Roberts et al. | 439/88 |
| 4,808,128 | 2/1989 | Werth | 439/610 |
| 4,828,512 | 5/1989 | McCormick et al. | 439/495 |
| 4,911,643 | 3/1990 | Perry et al. | 439/493 |
| 4,975,068 | 12/1990 | Squires | 439/77 |

FOREIGN PATENT DOCUMENTS

| | | |
|---|---|---|
| 2649374 | 5/1977 | Fed. Rep. of Germany . |
| 1539470 | 1/1979 | United Kingdom . |

*Primary Examiner*—Neil Abrams

*Attorney, Agent, or Firm*—Burns, Doane, Swecker & Mathis

[57] ABSTRACT

In a device for contacting shielded conductors, surrounded by shield and ground planes, a clamping means is disposed to press contact means connected to the conductors against each other as well as shield and ground planes which face each other and surround the contact means. A pad of an electrically conducting, elastic material is arranged between the clamping means and one of the contact means. The pad covers the contact area between the contact means and is in contact with the surrounding ground planes to form an electrically closed enclosure of the contact means.

16 Claims, 4 Drawing Sheets

DEVICE FOR CONTACTING SHIELDED CONDUCTORS

FIELD OF THE INVENTION

The present invention is related to a device for contacting shielded conductors surrounded by shield and ground planes.

BACKGROUND OF THE INVENTION

In electronic equipment and circuits for high frequencies and data signals having short transient times there is a need of conducting these signals in shielded, impedance matched conductors and to connect the conductors in the equipment and the circuit board with electrically conducting enclosures which short circuit electromagnetical radiation. Even small "slots" may transmit radiation which may interfere with other equipment and other circuits.

PRIOR ART

Conventional connectors for such applications have weaknesses in that they either are not closed at all connecting surfaces or that they are difficult to mount. This is especially true if the circuit is intended for surface mounted components. In addition prior connectors for high frequency transmission are costly which is a further disadvantage. A prior contact device of this kind could be found for instance in DE A 26 49 374.

SUMMARY OF THE INVENTION

The purpose of the present invention is to provide a device for contacting shielded conductors wherein the disadvantages discussed above in prior solutions are eliminated.

This purpose is achieved in a device for contacting two shielded conductors, each one of which is embedded in or located on a dielectric sheet or laminate. A shield and ground plane is located at least on one of the sides of each one of said conductors. A clamping or pressing means is arranged to press contact means against each other, as well as two of said shield and ground planes. The contact means have at least one substantially flat surface and one of the contact means is connected to or comprised in each one of said two conductors. Said two shield and ground planes surround the contact means, are substantially coplanar with the flat surfaces of the contact means and face each other. A pad of an electrically conducting, elastic material is arranged between said clamping or pressing means and one of the contact means in order to cover at least a portion of the contact area between the contact means. The pas is in contact with at least two of the shield and ground planes in order to form an electrically closed enclosure of the contact means.

According to an advantageous embodiment at least one contact means is made from an exposed portion of a stripline conductor, which is arranged between two dielectric isolating sheets, which on the outside are covered with conductive layers such as laminated metal foils, a recess being made in one plastics sheet and the associated foil in order to expose said contact means.

In an important application of the device one of the contact means is arranged on a circuit pattern board.

According to another advantageous embodiment the pad is made from elastic, conducting rubber, such as silicon rubber having coal as a filling agent.

SHORT DESCRIPTION OF THE FIGURES

An embodiment of the device according to the invention will now be described by way of example in more detail and with reference to the accompanying drawings, in which FIG. 1 shows a laminate having a stripline conductor, as seen obliquely from the bottom, and a circuit pattern board, as seen obliquely from the top.

FIG. 2 shows in a cross sectional view the laminate brought into contact with a circuit pattern board, as seen from the end of the conductor, FIG. 3 shows the contact area in a cross-sectional view and in a larger scale as seen in a direction perpendicular to that of FIG. 2, that is in the longitudinal direction of the conductor, FIGS. 4 to 7 illustrate some possible ways of arranging a pressing force.

DESCRIPTION OF THE PREFERRED EMBODIMENT

In the figures the thicknesses illustrated of the substrates and the foils are highly exaggerated in order to clarify the invention.

Figure 1:
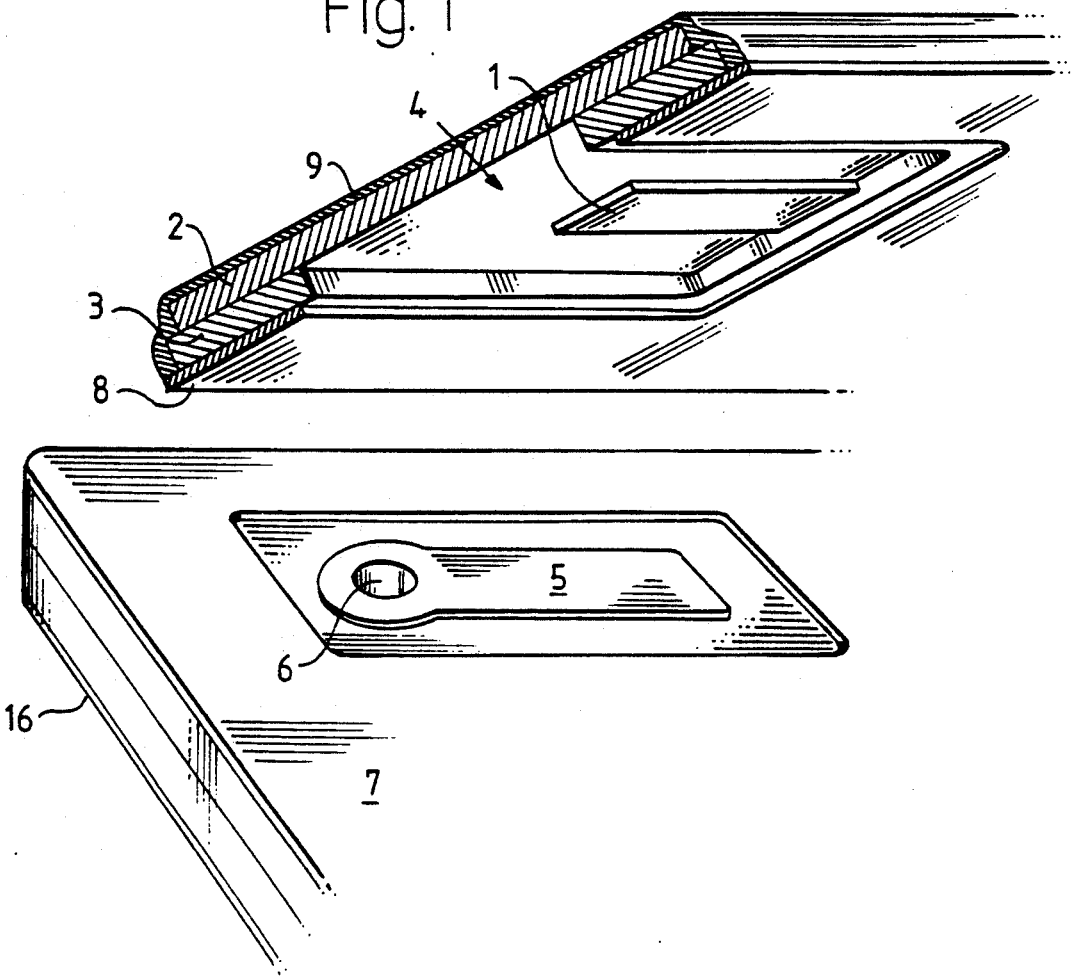

In FIG. 1 a laminate is shown with a stripline conductor, which has the shape of a conductive band and is arranged embedded between two laminated, thin dielectric plastics sheets 2, 3 to form a first laminate, illustrated in the top part of the Figure. On the exterior sides of the plastics sheets conductive layers in the shape of metal foils 8, 9 are applied in order to form shield and ground planes. Also the common edges of the dielectric sheets 2, 3 may be sealed by a conductive layer, as is illustrated in the Figure. The dielectric sheets 2, 3 consist of a top dielectric sheet 2 and a bottom dielectric sheet 3. In the bottom dielectric sheet 3, and the foil 8 covering this sheet 3 a substantially rectangular aperture or hole is arranged to form a recess 4 in the first laminate, this hole exposing a portion of the conductor. This exposed portion of the conductor forms one contact means 1 with a substantially flat outer surface and it has the shape of a thin band extending from one of the sides of the rectangular recess 4, is located on the inner side of the other dielectric sheet 2 and is immediately surrounded on some of its sides, in FIG. 1 on three sides, by isolating inner surface portions of the other dielectric sheet 2. In FIG. 1 the recess 4 extends from a free edge of the first laminate, this edge also being a common edge of the dielectric sheets 2, 3.

Below this contact means 1 in FIG. 1 a corresponding contact means 5 having the shape of a thin band with a substantially flat surface is arranged on the top surface or side of a multilayer circuit pattern board forming a second laminate, this contact means 5 for instance being a selected etched portion of the conductive pattern on top of the circuit board. The contact means 5 may also be connected to a conductor, for instance located inside the circuit pattern board, through a metallized or through-coated hole 6 which extends between a top ground plane 7 and a lower ground plane 16 of the circuit pattern board.

On the surface of the circuit pattern board where the contact means 5 is located there is also a shield and ground plane 7 surrounding laterally completely the contact means 5, this shield and ground plane for instance being another portion of the same conductive pattern as the contact means 5 of the circuit pattern board, and arranged to have its surface in essentially the same geometrical plane as the surface of the second contact means 5. On the other side of the circuit pattern board another conductive layer 16 is located and forms another shield and ground plane.

Figure 2:
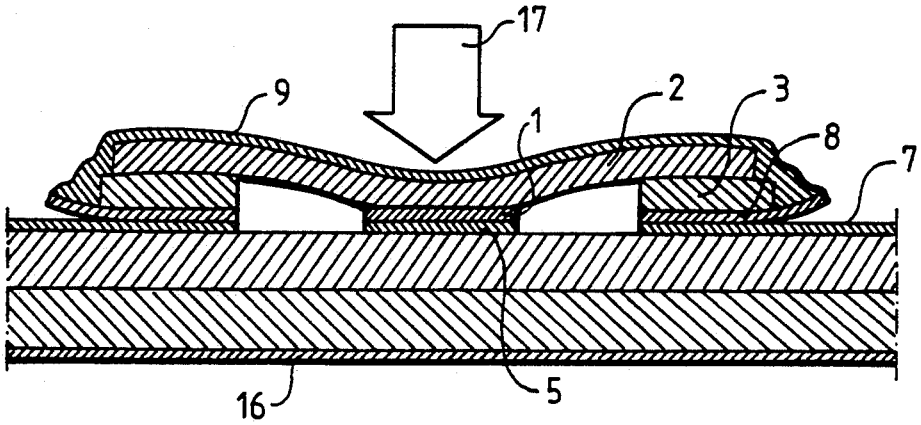

A contact between the contact means 1, 5 is established by applying the laminated first unit and the circuit pattern board to each other, that is positioning them at each other with their large sides in engagement with each other, and by pressing the contact means 1, 5 against each other by applying a force according to the arrow 17 in FIG. 2 on top of the first laminated unit at a location opposite to the recess 4 or the first contact means 1. The material of laminated unit, that is of the plastics sheet 2, which is left in the recess 4 will then be bent down towards the circuit board in the same time as the ground planes 7, 8, which already are engaged with each other and are located on the circuit pattern board and the laminated unit respectively, are pressed against each other in such a way that the contact area will be tightly shielded, but only in the case (not shown) where the recess 4 is located at an inner portion of the laminated unit and not extending to any of its edges. However, in the illustrated case, where the recess 4 extends from an edge of the first laminated unit, an unshielded narrow portion will be left along the common edge of the recess 4 and the laminated unit in the thickness of the dielectric sheet 3, in which the recess 4 is made.

Figure 3:
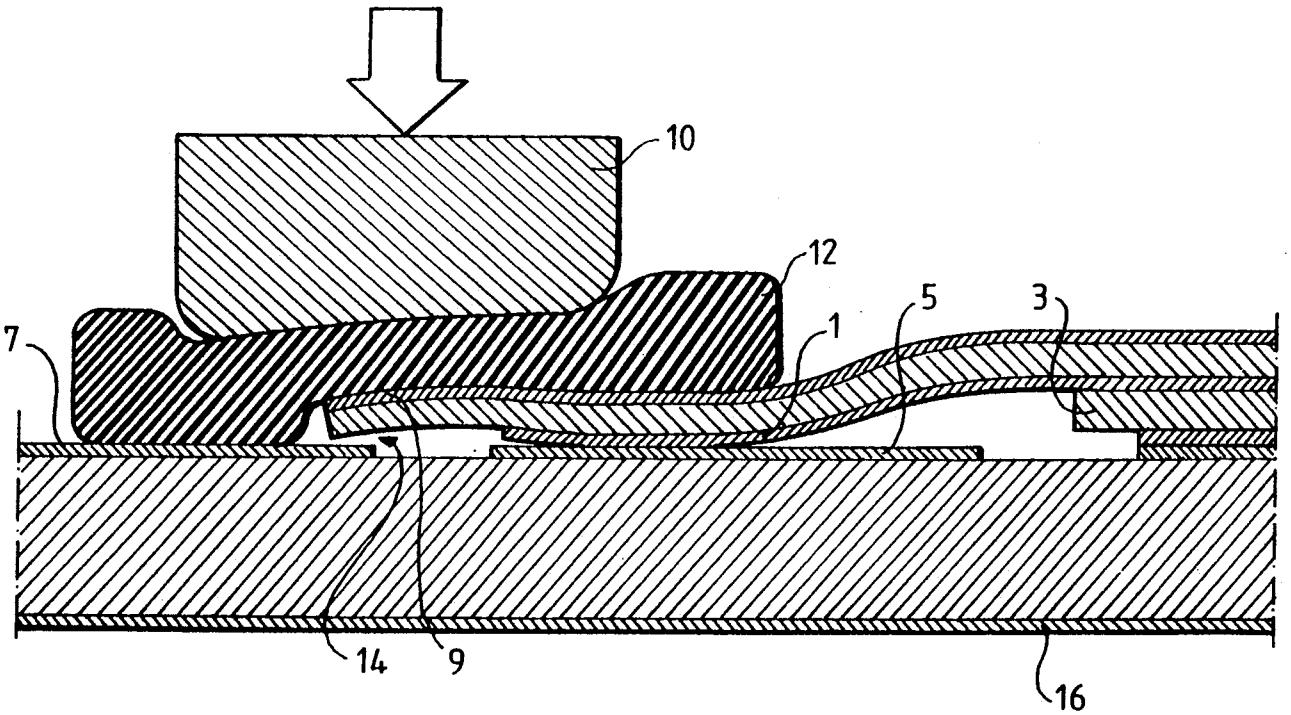

The press force is obtained by a suitable pressing means 10, as is illustrated in FIG. 3.

In order to shield also the said narrow portion at the outer edge of the recess 4, a pad 12 is arranged between the pressing means 10 and the laminated unit, the pad 12 being made of an electrically conducting, elastic material, such as coal filled silicon rubber. The pad is deformed due to the pressing force and will conform to the base material, whereby said narrow portion or slit at 14 in FIG. 3, due to the aperture 4 in the plastics sheet 3, will be closed by the pad 12, which thus will cover the contact area and ensure a completely closed shield around the contact means 1, 5 in contact with the surrounding shield and ground planes 7, 9. The elastic pad 12 also distributes the pressure in such a way that a smooth engagement both between the contact means 1, 5 and the surrounding metal foils enclosing the contact means at three sides thereof is obtained. A condition for this shielding effect of the elastic pad 12 is that the edge of the top laminate where the recess 4 is located, is positioned at a distance from the edges of the lower laminate.

In the illustrated case where the first laminate with the stripline conductor has a relatively small width, the whole exposed edge, from which the recess 4 extends, may be shielded by the elastic conductive pad 10. Generally, this edge of the first laminate may also be coated with a conductive layer, as is illustrated for the other edges in FIG. 1. Then only the common edge of the first laminate and the recess has to sealed by the elastic pad 10.

Figure 4:
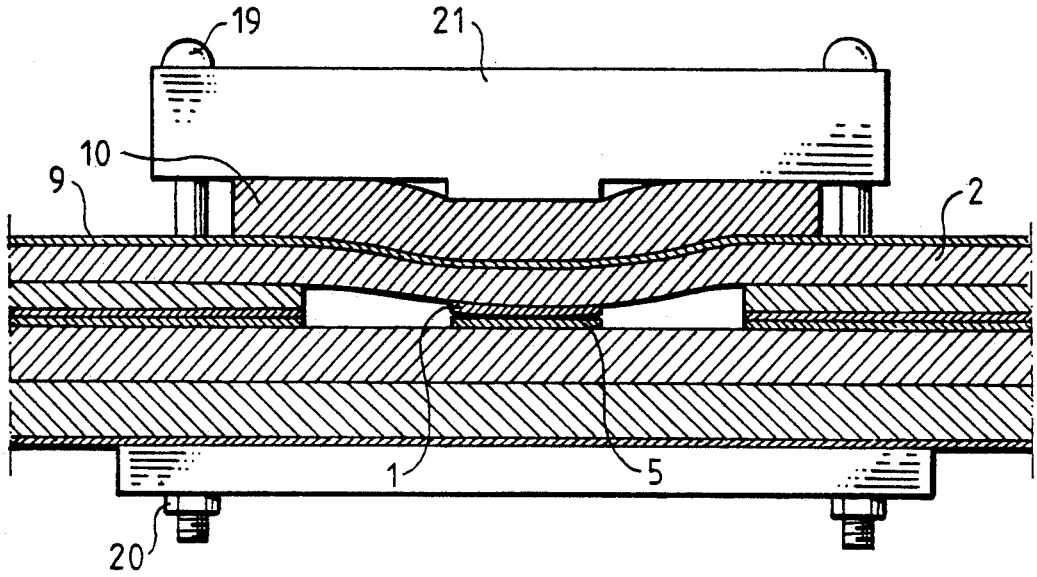

As is illustrated in FIG. 4 in a cross sectional view the press force may be obtained by two bolts 19 extending through holes in both laminates and tightened by nuts 20, the bolts 19 also acting on a stiff pressing element 21 with holes for the bolts 19. The pressing element 21 may have a suitably shaped pressing surface which acts on the top side of the elastic pad 10 to press it into the desired contact with the ground planes 9 and 7 and also to press the contact means 1, 5 against each other. Another stiff element 22 may be arranged at the bottom of the circuit board, opposite to the second contact means 5, to eliminate bending of the circuit board.

Figure 5:
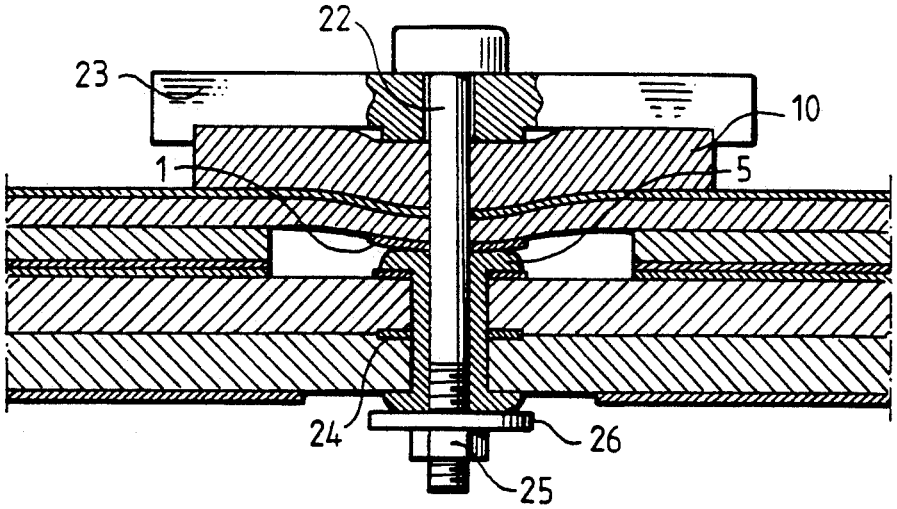

The bolts may also pass through the contact means 1, 5 and this case is illustrated in FIG. 5. A bolt 22 made from an isolating material passes through holes in the two laminates, in the elastic pad 10 and in a stiff element 23 arranged and acting in a similar way as the stiff element 21 of FIG. 4. The hole in the circuit board laminate may be a plated or metallized hole used for connection of the contact means 5 and an inner conductor 24 of the circuit board. An isolating nut 25 is threadedly engaged with the bolt 22 and a washer 26 may be arranged under the nut 25.

Figure 6:
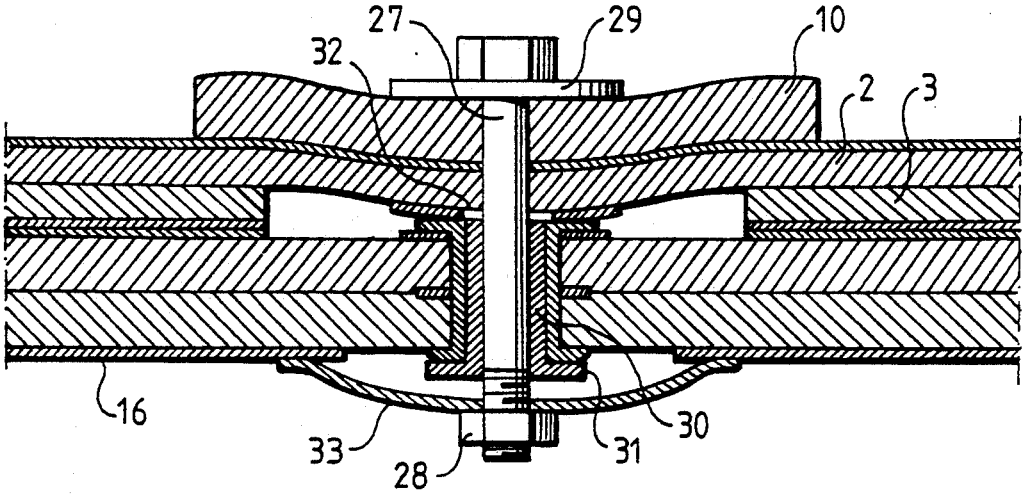

With a conductive bolt made from metal a shielding even of the bottom of the circuit board may be obtained, as is illustrated in FIG. 6. Thus a metal bolt 27 cooperating with a metal nut 28 is used and gives a pressing force in the same way as the bolt 22 of FIG. 6. A stiff element 29, through which the bolt 27 passes, has the shape of a large diameter washer. The bolt 27 should not contact the metallized hole in the circuit board and therefor an isolating sleeve 30 having a collar 31 is placed inside the metallized hole. Thus this hole in the contact means 5 in circuit pattern board may have a little larger diameter than the hole through the top laminate. Also the contact means 1 of the top laminate should not extend up to this hole so that an isolating marginal portion 32 is exposed in the top dielectric sheet 2 adjacent to the hole.

In order to shield the area at the bottom surface around the through-hole in the circuit pattern board a conductive cap 33 having a hole in the centre thereof, through which the bolt 27 passes, is located at the bottom surface and has its outer portions pressed against the ground layer 16. Around the hole in the circuit board this ground layer 16 is, as is conventional, removed in order to be isolated from the metallization in the through-hole. The conductive cap 33 has preferably a concavely shaped surface directed to said ground plane 16.

Figure 7:
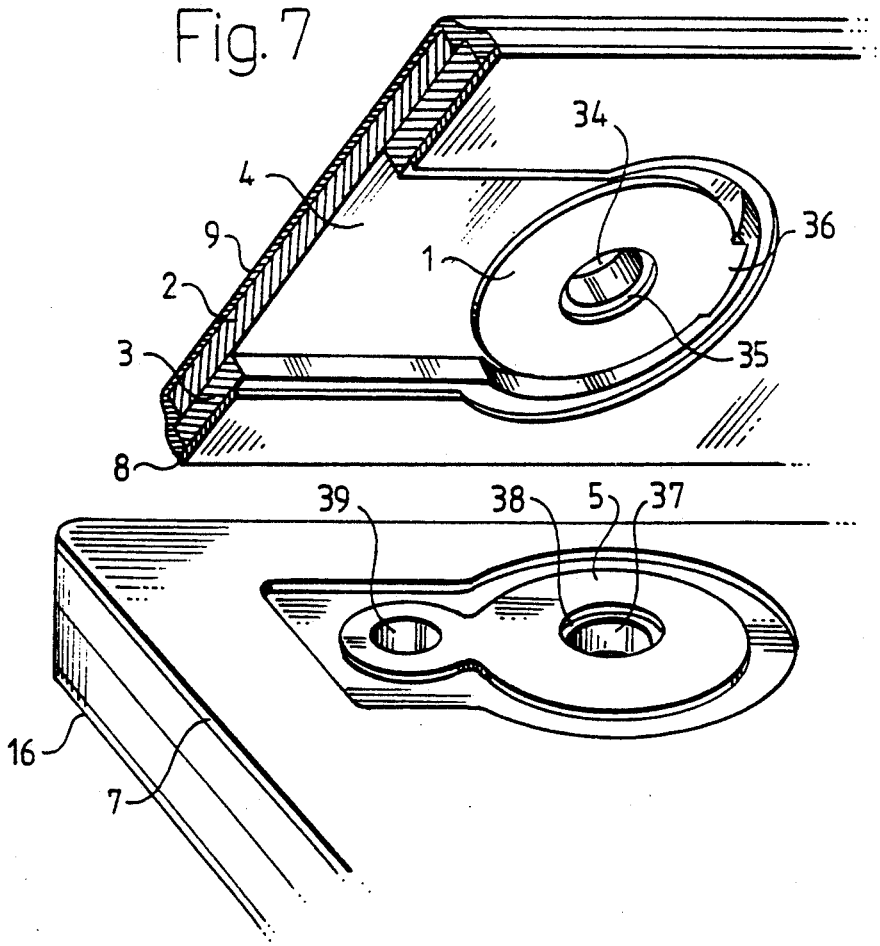

The screw applying the pressing force may also pass the contact means 1, 5 through ordinary holes not having a metallization. This case is illustrated in FIG. 7 where the first contact means 1 has a circular or annular shape with a hole 34 located at its centre. The contact means 1 may in this case, for a conductive bolt, not reach the edge of the hole and thus an annular flat region 35 is obtained on the inner surface of the dielectric sheet 2. In this way the contact means 1 is isolated from the screw intended to pass through the hole 34. The contact means 1 is connected to a conductor through a connecting bridge 36.

In the lower laminate the contact means 5 has an elongated shape surrounding at one end a hole 37, through which the clamping screw is intended to pass. Here also there may be an annular area immediately surrounding the hole 37 and not covered by the contact means 5. At the other end of the contact means a through-metallized or plated hole 39 is located which thus connects the contact means 5 with signal conductors inside the circuit board. The contact means 5 is surrounded at all its lateral sides, that is in a geometrical plane passing through the surface of the contact means 5, by the ground plane 7. Likewise, as above the shape and location of the inner edge of this surrounding ground plane 7 is adapted to fit to the recess 4 in the top laminate. The contact means 5 may in this case be part of the metallization deposited for the through-plating of the electrically connecting hole 39, this implying the top surface of the contact means 5 being essentially flat.

We claim:

1. A device comprising:

first and second laminates, each comprising first and second dielectric sheets, said first dielectric sheet having a first recess formed therein;

a conductor disposed between the two dielectric sheets;

contact means connected to or integrally formed on the conductor, and having at least one substantially flat surface exposed at one side of the laminate by first and second recesses formed, respectively, in the first dielectric sheet and in a shield and ground plane; and a shield and ground plane substantially covering at least one side of said conductor, the shield and ground plane being substantially coplanar with the flat surface of the contact means on said at least one side of said conductor, and having formed therein a second recess for exposing the flat surface of the contact means;

wherein the first and second laminates are disposed so that the contact means of the first laminate faces the contact means of the second laminate, and wherein the device further comprises:

clamping or pressing means for pressing together the contact means of the first and second laminates and for pressing together the shield and ground planes of the first and second laminates; and a pad of an electrically conducting, elastic material disposed between the clamping or pressing means and one of the contact means, the pad covering a contact area between the contact means of the first and second laminates and being in contact with at least two surrounding shield and ground planes in order to form an electrically closed enclosure of the contact means, wherein said first recess extends from a common edge of said first and second dielectric sheets and said pad is arranged to cover at least said common edge.

2. A device comprising:

a first and second laminate, each comprising:

first and second dielectric sheets;

conductors disposed between the dielectric sheets;

a shield and ground plane on an outer side of the first and second dielectric sheet; and contact means, connected to or integrally formed on the conductors, the contact means having at least one substantially flat surface;

clamping or pressing means; and a pad of an electrically conducting, elastic material disposed between said clamping or pressing means and the first contact means, a first one of said contact means being located in a recess in the surface of the first laminate and extending to an edge of the first laminate, a second one of said contact means being located on a surface of the second laminate and surrounded at least partially by a shield and ground plane having a surface substantially in the same geometrical plane as the surface of the second contact means, the laminates being located in contact with each other with the contact means facing each other, a common edge of the first laminate and the recess over its whole length being positioned above said shield and ground plane surrounding the second contact means, the clamping or pressing means being arranged to press the contact means against each other as well as said common edge and said surrounding shield and ground, the pad being disposed between said clamping or pressing means and the first contact means, said pad covering at least a portion of the contact area between the contact means and covering said common edge and being in electrical contact with the outer shield and ground plane on the first laminate and the surrounding shield and ground plane on the second laminate in order to form an electrically closed enclosure of the contact means.

3. A device according to claim 2, wherein said surrounding shield and ground plane surrounds the second contact means on all sides in said geometrical plane.

4. A device according to claim 2, wherein the edge of the first laminate, of which said common edge is a part, is shielded by a conductive layer.

5. A device according to claim 2, wherein a shield and ground plane, which is located on an inner side of the first laminate is pressed against the surrounding shield and ground plane on the second laminate.

6. A device according to claim 5, wherein the shield and ground plane located on the inner side of the first laminate surrounds the recess.

7. A device according to claim 2, wherein the second laminate comprises a circuit pattern board, having conductors on an inner side thereof, one portion of one of said conductors being one of the contact means.

8. A device according to claim 2, wherein the pressing or clamping means comprises at least one tightening element passing through the two laminates adjacent to but at some distance from the contact means.

9. A device according to claim 2, wherein the pressing or clamping means comprises at least one tightening element passing through the contact means and the two laminates.

10. A device according to claim 9, wherein the tightening element is made from an isolating material.

11. A device according to claim 8, wherein the wall of a hole in one of the laminates, through which the tightening element passes, is at least partly metallized in order to connect conductors located on different levels in or on the laminate with each other.

12. A device according to claim 8, wherein the wall of a hole in the second laminate, through which the tightening element passes, is at least partly metallized in order to connect conductors located on different levels in the second laminate with each other and wherein further, this hole is isolated by an area on the surface of an underlying dielectric sheet which is surrounded by a shield and ground plane and wherein further a conductive cap is located to cover said end and the surrounding area and to contact the surrounding shield and ground plane along its border.

13. A device according to claim 12, wherein the tightening element also passes through the conductive cap to press it against said surrounding shield and ground plane.

14. A device according to claim 13, wherein the tightening element is made from a conductive material contacting the conductive cap.

15. A device according to claim 8, wherein the tightening element is at least partly surrounded by an isolating sleeve.

16. A device for contacting two shielded conductors, each comprising a conductor which is disposed between two dielectric sheets, the dielectric sheets having a common edge and being substantially surrounded by a shield and ground plane, the device comprising:

contact means connected to or integrally formed on each of the conductors at an exposed portion of the respective conductor;

clamping or pressing means for pressing the contact means against each other and for pressing the shield and ground planes against each other, comprising at least one tightening element passing through the contact means; and a pad of electrically conducting, elastic material disposed between the clamping or pressing means and one of the contact means, the pad extending to cover a contact area between the contact means and the common edge of the dielectric sheets of one of the shielded conductors and being in electrical contact with at least two of the surrounding shield and ground planes in order to form an electrically closed enclosure of the contact means.

* * * * *